US012655995B2

(12) United States Patent
Chi et al.

(10) Patent No.: US 12,655,995 B2
(45) Date of Patent: Jun. 16, 2026

(54) AIR BLOWER ASSEMBLY AND DUCTED AIR CONDITIONER

(71) Applicant: Gree Electric Appliances, Inc. of Zhuhai, Zhuhai (CN)

(72) Inventors: Xiaolong Chi, Zhuhai (CN); Yifan Zhang, Zhuhai (CN); Biyao Zhang, Zhuhai (CN); Shaojun Ding, Zhuhai (CN); Kai Xia, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 127 days.

(21) Appl. No.: 18/682,015

(22) PCT Filed: Aug. 3, 2022

(86) PCT No.: PCT/CN2022/109914
§ 371 (c)(1),
(2) Date: Feb. 7, 2024

(87) PCT Pub. No.: WO2023/087785
PCT Pub. Date: May 25, 2023

(65) Prior Publication Data

US 2024/0353116 A1 Oct. 24, 2024

(30) Foreign Application Priority Data

Nov. 20, 2021 (CN) ..... 202111381036.5

(51) Int. Cl.
*F24F 1/0033* (2019.01)
*F24F 1/0014* (2019.01)

(52) U.S. Cl.
CPC ..... *F24F 1/0033* (2013.01); *F24F 1/0014* (2013.01)

(58) Field of Classification Search
CPC ..... F24F 1/0033; F24F 1/0029; F24F 1/0047; F04D 17/04; F04D 25/105; F04D 25/166
See application file for complete search history.

(56) References Cited

U.S. PATENT DOCUMENTS 5,984,649 A * 11/1999 Kato ..... F24F 1/0029 417/423.5
2008/0242212 A1* 10/2008 El-Galley ..... F24F 13/06 454/258

(Continued)

FOREIGN PATENT DOCUMENTS

CN 205065930 U 3/2016
CN 206360913 U 7/2017

(Continued)

OTHER PUBLICATIONS

EP 22894328, Extended European Search Report, Feb. 7, 2025.
International Search Report, PCT/CN2022/109914, Oct. 25, 2022.

*Primary Examiner* — Nelson J Nieves
(74) *Attorney, Agent, or Firm* — The Webb Law Firm

(57) ABSTRACT

An air blower assembly and a ducted air conditioner are provided. An air blower assembly includes a plurality of air blowers, wherein the plurality of air blowers are sequentially connected and capable of rotating at a same time to change orientations of air outlets of the plurality of air blowers, and rotating axes of the plurality of air blowers are collinear; and a driving apparatus, in driving connection with the plurality of air blowers and configured to drive the plurality of air blowers.

17 Claims, 4 Drawing Sheets

(56) References Cited

U.S. PATENT DOCUMENTS

| | | | | |
|---|---|---|---|---|
| 2012/0018117 | A1* | 1/2012 | Yamada | F24F 1/0063 165/104.34 |
| 2013/0153173 | A1* | 6/2013 | Nakamura | F24F 11/77 165/96 |
| 2015/0168008 | A1* | 6/2015 | Sakoda | F24F 13/08 165/121 |
| 2020/0124295 | A1* | 4/2020 | Kawamura | F24F 1/0063 |
| 2025/0198466 | A1* | 6/2025 | Kan | F16D 1/108 |
| 2025/0224133 | A1* | 7/2025 | Ge | F24F 11/89 |

FOREIGN PATENT DOCUMENTS

| | | | | |
|---|---|---|---|---|
| CN | 105202730 | B | | 10/2018 |
| CN | 208186508 | U | | 12/2018 |
| CN | 109945302 | A | | 6/2019 |
| CN | 209689039 | U | | 11/2019 |
| CN | 109099510 | B | | 3/2020 |
| CN | 210602183 | U | | 5/2020 |
| CN | 110056956 | B | | 8/2020 |
| CN | 111895503 | A | | 11/2020 |
| CN | 212901759 | U | | 4/2021 |
| CN | 213747026 | U | | 7/2021 |
| CN | 214009372 | U | | 8/2021 |
| CN | 214223704 | U | | 9/2021 |
| CN | 214307342 | U | | 9/2021 |
| CN | 214581542 | U | | 11/2021 |
| CN | 109780709 | B | | 12/2021 |
| CN | 113513787 | B | | 5/2022 |
| CN | 114484600 | A | | 5/2022 |
| CN | 216769592 | U | | 6/2022 |
| JP | 59056027 | A | * | 3/1984 |
| JP | 2009156558 | A | | 7/2009 |
| JP | 2011133173 | A | * | 7/2011 |

* cited by examiner

AIR BLOWER ASSEMBLY AND DUCTED AIR CONDITIONER

CROSS-REFERENCE TO RELATED APPLICATIONS

The application is the United States National Phase of International Patent Application No. PCT/CN2022/109914, filed Aug. 3, 2022, and claims priority to Chinese Patent Application No. 202111381036.5, filed Nov. 20, 2021, the disclosure of which are hereby incorporated by reference in their entireties.

BACKGROUND OF THE INVENTION

Field of the Invention

The present disclosure relates to the technical field of an air treatment device, and in particular to an air blower assembly and a ducted air conditioner.

Description of Related Art

Generally, an indoor unit of an air conditioner includes at least two air ports, one is only used for air exhaust and the other one is only used for air return, and airflow flows between the two air ports through the rotation of an air blower in the indoor unit of the air conditioner. With the continuous improvement of people's pursuit on the comfortability of the air conditioner, the indoor unit of the air conditioner is required to change the air outlet direction according to the working mode, but due to the directional requirements of a fan blade of the air blower, it is difficult to change the airflow direction after a motor driving the fan blade to rotate is reversed, so that the air outlet direction of the indoor unit cannot be adjusted, thus the air outlet direction is single, and it is difficult to meet the diversified requirements of users.

In some related arts, a plurality of mixed flow air blowers are provided so that the mixed flow air blowers turn 180° in the indoor unit of the air conditioner, and reversed air exhaust is achieved. However, in these schemes, the plurality of mixed flow air blowers are arranged on respective bases in parallel, and each of the mixed flow air blowers rotates independently along an axis perpendicular to the base. This structure is not only more complicated, but also necessary to keep a rotation gap between the adjacent two air blowers to prevent the mutual interference between the adjacent air blowers during rotation, so that the space occupation rate of the whole air blower assembly is increased, and thus the product competitiveness is reduced. Therefore, how to reduce the space occupation rate of the air blower assembly and simplify the structure are urgent problems to be solved in the field.

SUMMARY OF THE INVENTION

The present disclosure provides an air blower assembly and a ducted air conditioner, which can solve the problems in the related art that a rotatable air blower assembly has a high space occupation rate and a complicated structure.

According to one aspect of the present disclosure, an air blower assembly is provided and includes: a plurality of air blowers, wherein the plurality of air blowers are sequentially connected and capable of rotating at a same time to change orientations of air outlets of the plurality of air blowers, and rotating axes of the plurality of air blowers are collinear; and a driving apparatus, in driving connection with the plurality of air blowers and configured to drive the plurality of air blowers to rotate.

In some embodiments, the air blower assembly further includes: a mounting bracket, wherein the plurality of air blowers are connected to the mounting bracket.

In some embodiments, at least one of the plurality of air blowers is connected to the driving apparatus, and at least one of the plurality of air blowers is connected to the mounting bracket.

In some embodiments, the mounting bracket includes two first mounting brackets, which are rotatably connected to an air blower located at a first end of the plurality of air blowers and an air blower located at a second end of the plurality of air blowers, respectively; and the driving apparatus is in driving connection with the air blower located at the first end of the plurality of air blowers.

In some embodiments, the mounting bracket includes a second mounting bracket located between adjacent two air blowers.

In some embodiments, the mounting bracket has an assembling hole; and the air blower connected to the mounting bracket has a rotating structure, and the rotating structure is rotatably arranged in the assembling hole.

In some embodiments, the rotating structure has a first limiting portion, the mounting bracket has a second limiting portion, the second limiting portion is located on a moving path of the first limiting portion, and the first limiting portion is configured that when the rotating structure rotates to a preset position, the first limiting portion mates with the second limiting portion so as to limit a continuous rotation of the rotating structure.

In some embodiments, the mounting bracket has an auxiliary limiting tongue for mounting and limiting.

In some embodiments, the mounting bracket has a hand-held hole for a finger to pass through.

In some embodiments, the mounting bracket includes: an upper bracket and a lower bracket, the upper bracket is detachably connected to the lower bracket, the upper bracket has a first assembling groove, the lower bracket has a second assembling groove, and the first assembling groove and the second assembling groove enclose the assembling hole.

In some embodiments, a volute casing of an air blower includes a first shell and a second shell which are connected to each other, and first shells of the plurality of air blowers are integrally formed.

In some embodiments, a volute casing of an air blower includes a first shell and a second shell which are connected to each other, and second shells of the plurality of air blowers are integrally formed.

In some embodiments, the air blowers are detachably connected.

In some embodiments, each of the air blowers is any one of a mixed flow air blower, an axial flow air blower or a centrifugal air blower.

In some embodiments, the driving apparatus is driven by a motor or driven manually.

According to another aspect of the present disclosure, a ducted air conditioner is provided and includes the above-mentioned air blower assembly.

In some embodiments, a shell of the ducted air conditioner is provided with a lower air port and a side air port, and each of the air blowers has a first orientation and a second orientation; when the ducted air conditioner is in a cooling mode, the air blower is located in the first orientation, the lower air port is configured to take in air, and the side air port is configured to exhaust air; and when the ducted air conditioner is in a heating mode, the air blower is located in the second orientation, and the side air port is configured to take in air, and the lower air port is configured to exhaust air.

In some embodiments, an orientation of an air suction port of the air blower is configured that when the lower air port serves as an air inlet, the orientation of the air suction port form a first inclination angle o with a horizontal direction, and an angle range of the first inclination angle $\alpha$ meets: $0 \leq \alpha \leq 12°$.

In some embodiments, an orientation of an air exhaust port of the air blower is configured that when the lower air port serves as an air outlet, the orientation of the air exhaust port form a second inclination angle $\beta$ with a horizontal direction, and an angle range of the second inclination angle $\beta$ meets: $0° < \beta > 15°$.

According to the air blower assembly of the embodiments of the present disclosure, the rotating axes of all the air blowers are collinear, so that a rotation gap is not reserved between the air blowers, a distance between the air blowers can be shortened, even the air blowers are connected together, thereby greatly reducing the space occupation rate of the air blower assembly, shortening the overall length of the air conditioner and improving the product competitiveness.

BRIEF DESCRIPTION OF THE DRAWINGS

The accompanying drawings, which form part of the description, illustrate embodiments of the present disclosure and together with the description, serve to explain the principles of the present disclosure.

The present disclosure can be more clearly understood from the following detailed descriptions with reference to the accompanying drawings, in which.

Figure 1:
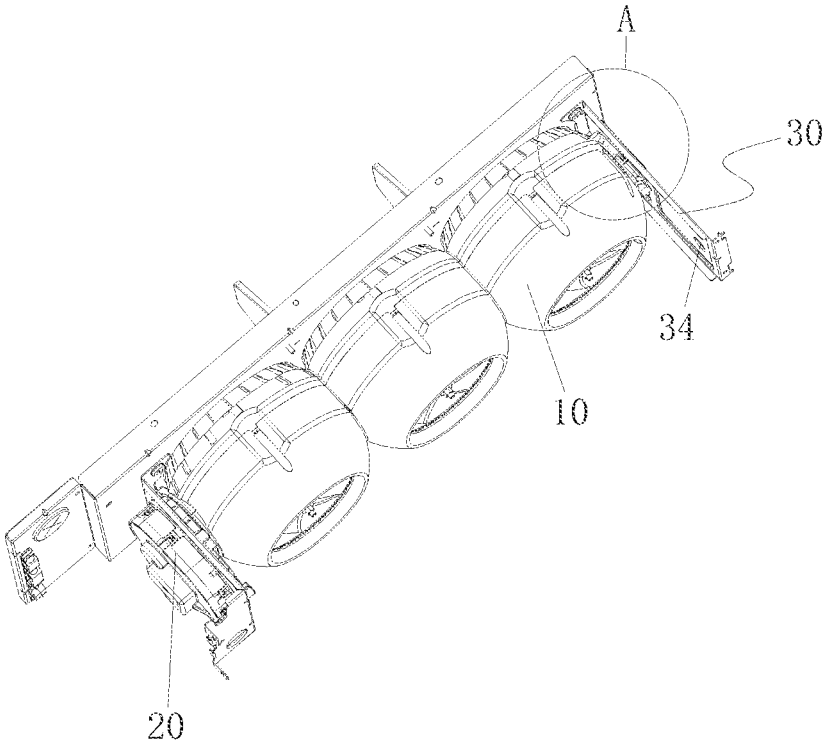
FIG. 1 is a structural schematic diagram of some embodiments of an air blower assembly of the present disclosure.

It should be understood that the dimensions of various parts shown in the accompanying drawings are not drawn according to an actual scale relationship. In addition, the same or similar reference signs indicate the same or similar components.

Reference numerals of the drawings: 10. air blower; 11. rotating structure; 12. first limiting portion; 13. first shell; 14. second shell; 20. driving apparatus; 30. mounting bracket; 31. assembling hole; 32. second limiting portion; 33. auxiliary limiting tongue; 34. handheld hole; 35. upper bracket; 36. lower bracket.

DESCRIPTION OF THE INVENTION

Various exemplary embodiments of the present disclosure will now be described in detail with reference to the accompanying drawings. The descriptions of the exemplary embodiments are merely illustrative and are in no way intended to limit the present disclosure, and application or uses thereof. The present disclosure can be implemented in many different forms and is not limited to the embodiments described herein. These embodiments are provided, so that the present disclosure will be thorough and complete, and will fully convey the scope of the present disclosure to those skilled in the art. It should be noted that unless otherwise specified, the relative arrangement of components and steps, the composition of materials, numerical expressions and numerical values set forth in these embodiments should be interpreted as merely illustrative and not as limitative.

Similar words of "first", "second" and the like used in the present disclosure do not indicate any order, quantity or importance, but are only used to distinguish different parts. Similar words such as "including" or "comprising" mean that the elements before the word cover the elements listed after the word, without excluding the possibility of covering other elements. "Upper", "lower", "left", "right" and the like are only used to indicate a relative positional relationship. After the absolute position of a described object changes, the relative positional relationship may also change accordingly.

In the present disclosure, when it is described that a specific device is located between a first device and a second device, there may be an intervening device between the specific device and the first device or the second device or not. When it is described that the specific device is connected to other devices, the specific device may be directly connected to the other devices without the intervening device, and may also have the intervening device without being directly connected to the other devices.

All terms (including technical terms or scientific terms) used in the present disclosure have the same meanings as those understood by ordinary skilled in the art to which the present disclosure belongs, unless otherwise defined particularly. It should also be understood that the terms defined in, for example, general dictionaries should be interpreted as having the meanings consistent with their meanings in the context of the related art, and should not be interpreted in an idealized or extremely formal sense unless explicitly defined herein.

Technologies, methods and equipment known to those skilled in the related art may not be discussed in detail, but the technologies, methods and equipment should be regarded as part of the description under appropriate circumstances.

FIG. 1 is a structural schematic diagram of some embodiments of an air blower assembly of the present disclosure. As shown in FIG. 1, embodiments of the present disclosure provide an air blower assembly, including a plurality of air blowers 10 and a driving apparatus 20; the plurality of air blowers 10 are connected sequentially and are capable of rotating at the same time to change the orientations of air outlets of the air blower assembly, and rotating axes of the plurality of air blowers 10 are collinear; and the driving apparatus 20 is in driving connection with the plurality of air blowers 10 and is configured to drive the plurality of air blowers 10 to rotate. During rotation of the plurality of air blowers 10, the driving apparatus 20 can cause all the air blowers 10 to rotate at the same time and change the orientation of the air outlet so as to achieve reverse air exhaust.

In this embodiment, the rotation of the air blowers 10 refers to the overall rotation of the air blowers 10 rather than the rotation of blades in the air blowers 10. According to the air blower assembly of the embodiments of the present disclosure, the rotating axes of all the air blowers 10 are collinear, so that a rotation gap is not reserved between the air blowers 10, a distance between the air blowers 10 can be shortened, even the air blowers are connected together, thereby greatly reducing the space occupation rate of the air blower assembly, shortening the overall length of the air conditioner and improving the product competitiveness.

In the related art, the air blowers 10 are separately mounted with the bracket. Therefore, both the structure of the bracket and the assembling mode of the air blowers 10 are very complicated. In the assembling and disassembling process, an operator needs to perform an assembling and disassembling operation in a suspended ceiling, so the mounting and operation processes are very inconvenient.

In some embodiments, the air blower assembly further includes a mounting bracket 30, and the plurality of air blowers 10 are connected to the mounting bracket 30. Specifically, as shown in FIG. 1, the plurality of air blowers 10 are strung together like sugar-coated haws, and the adjacent two air blowers are mutually fixed. Therefore, to simplify the assembling structure of the whole body, the mounting bracket 30 can be arranged on the air blowers at two ends of the air blower assembly, respectively. During assembling, the air blowers 10 and the mounting bracket 30 form a whole body, and the air blowers 10 are fixed in an air duct through the mounting bracket 30. In the mounting process, the air blowers 10 are mounted on the mounting bracket 30 and then the mounting bracket 30 is fixed in the air duct; during disassembling, after the mounting bracket 30 is disassembled, the mounting bracket and the air blowers 10 can be taken out together; compared with the ducted air conditioner with the rotatable air blowers in the related art, the disassembling and assembling process is simplified when the operator operates; furthermore, after the air blowers 10 and the mounting bracket 30 are overall taken out, the air blowers 10 can be disassembled and maintained in a wide and bright place, so that the operation process is more convenient and the working efficiency is improved.

In some embodiments, at least one of the plurality of air blowers 10 is connected to the driving apparatus 20, and at least one of the plurality of air blowers 10 is connected to the mounting bracket 30. The driving apparatus 20 can drive the air blowers 10 to rotate on the mounting bracket 30 so as to achieve reverse air exhaust.

Figure 3:
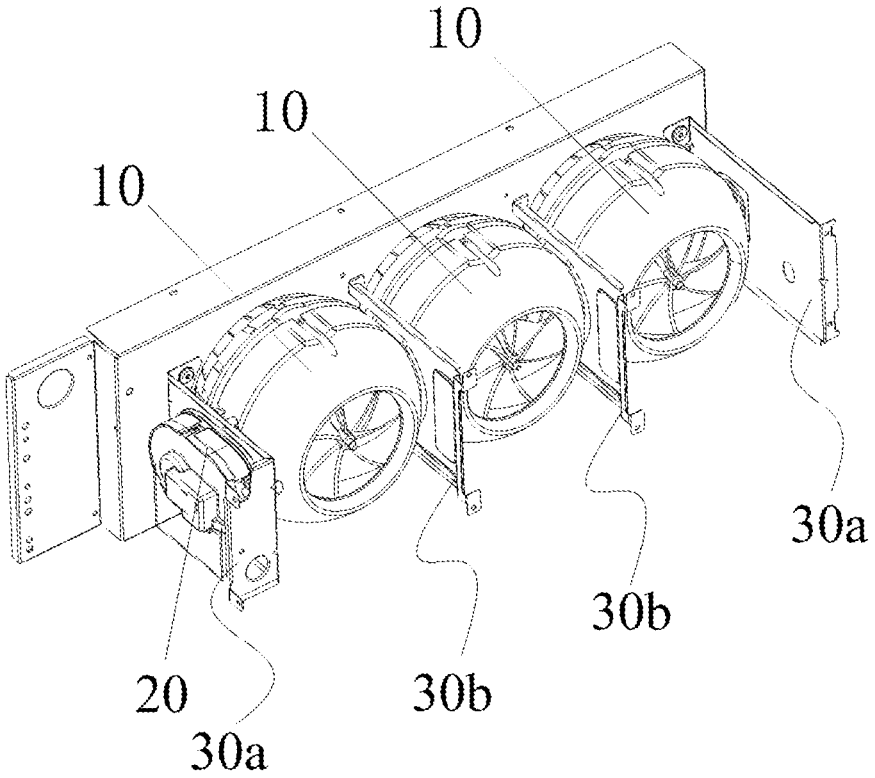
FIG. 3 is a structural schematic diagram of some other embodiments of an air blower assembly of the present disclosure.

FIG. 3 is a structural schematic diagram of some other embodiments of an air blower assembly of the present disclosure. Referring to FIG. 1 and FIG. 3, in this embodiment, the driving apparatus 20 can be arranged on the air blower 10 at the leftmost end in FIG. 1; meanwhile, the mounting bracket 30 may include two first mounting brackets 30*a* which are rotatably connected to the air blower located at a first end (the air blower at the leftmost end in FIG. 1 and FIG. 3) of the plurality of air blowers 10 and the air blower located at a second end (the air blower at the rightmost end in FIG. 1 and FIG. 3) of the plurality of air blowers, respectively. That is, the air blowers 10 at the leftmost end and the rightmost end are arranged on two first mounting brackets 30*a*, respectively.

The plurality of air blowers 10 are fixed in the air duct through the two brackets, and the driving apparatus 20 drives the air blowers 10 to rotate so as to achieve reverse air exhaust. The air blowers 10 are arranged collinearly, so the plurality of air blowers 10 can be driven by one driving apparatus 20 at the same time, the number of the driving apparatuses 20 can be saved, and wiring is more conveniently. On one hand, the product cost is reduced without affecting the production function; and on the other hand, the overall structure is greatly simplified, the assembling space is saved and the post-maintenance is facilitated.

It should be also noted that the number and assembling modes of the driving apparatuses 20, and the assembling modes of the mounting bracket 30 may be varied. In some embodiments not shown, the number of the driving apparatuses 20 may be two or three. In a case that the number of the driving apparatuses 20 is two, one driving apparatus 20 can drive one or more air blowers 10, and the other driving apparatus 20 can drive the other air blowers 10, so that the burden of each driving apparatus 20 can be reduced. Meanwhile, in a case that one driving apparatus 20 is damaged, driving can be performed by the other driving apparatus 20, so that the operation reliability of the ducted air conditioner can be ensured.

The mounting bracket 30 may be mounted on the air blowers 10 at two ends. Referring to FIG. 3, in some embodiments, the mounting bracket 30 includes a second mounting bracket 30*b* located between the adjacent two air blowers 10, which has the advantage that a supporting force may be provided between the two air blowers 10 by the second mounting bracket 30*b*, so that connection at the connection position between the air blowers 10 is more reliable, the sagging of the air blowers 10 due to the weight can be prevented, and the overall operation reliability of the air blowers 10 can be improved.

Figure 4:
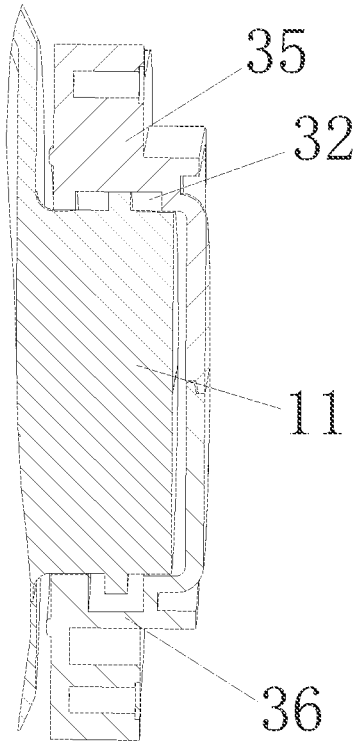
FIG. 4 is a schematic diagram of cooperation between a rotating structure and an assembling hole in an embodiment of an air blower assembly of the present disclosure.
Figure 5:
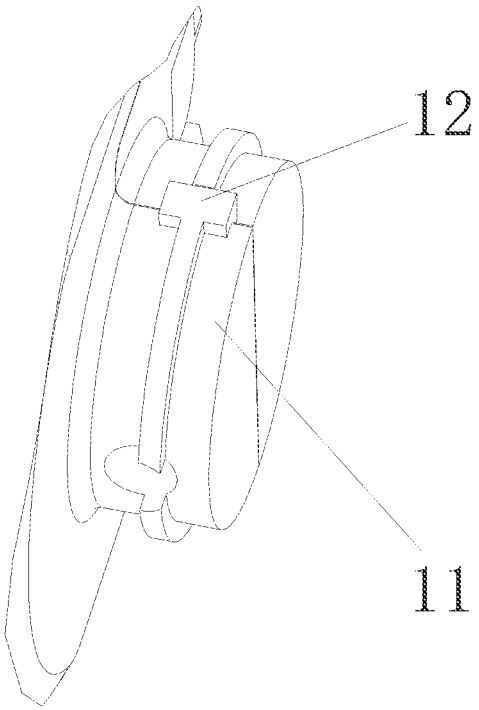
FIG. 5 is a structural schematic diagram of a rotating structure in an embodiment of an air blower assembly of the present disclosure.
Figure 6:
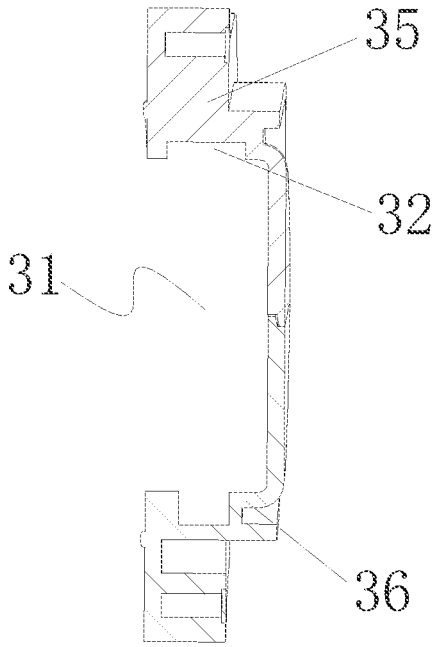
FIG. 6 is a structural schematic diagram of an assembling hole in an embodiment of an air blower assembly of the present disclosure.

In some embodiments, as shown in FIG. 4 to FIG. 6, the mounting bracket 30 has an assembling hole 31; and the air blower 10 connected to the mounting bracket 30 has a rotating structure 11, and the rotating structure 11 is rotatably arranged in the assembling hole 31. The rotating structure 11 is arranged in the assembling hole 31, thereby achieving the rotation of the air blowers 10. Specifically, the rotating structure 11 is arranged on the air blower 10 on the rightmost side in FIG. 1 and FIG. 3; and as shown in FIG. 4, the rotating structure 11 is a cylindrical rotating shaft protruding from the surface of the air blower 10, a mounting hole in the mounting bracket 30 mates with the rotating shaft, and the air blower 10 is rotatably arranged on the mounting bracket 30 through the rotating shaft.

In some embodiments, as shown in FIG. 5, the rotating structure 11 has a first limiting portion 12; and as shown in FIG. 6, the mounting bracket 30 has a second limiting portion 32, and the second limiting portion 32 is located on a moving path of the first limiting portion 12. When the rotating structure 11 rotates to a preset position, the first limiting portion 12 can mate with the second limiting portion 32 so as to limit the continuous rotation of the rotating structure 11.

In this embodiment, the first limiting portion 12 is arranged on a surface of the rotating structure 11, the second limiting portion 32 is arranged in the assembling hole 31, the first limiting portion 12 is a limiting protrusion, the second limiting portion 32 may be a limiting groove in an inner wall of the assembling hole 31, the limiting protrusion can move in the limiting groove, and a length of the limiting groove is a rotation stroke of the air blower 10. When moving to one end of the limiting groove, the limiting protrusion is in contact with an end wall of the limiting groove to form a limiting fit so as to limit the continuous rotation of the air blower 10. The rotation angle of the air blower 10 can be limited by this limiting mode, so that the air blower 10 rotates in a present angle range, thereby ensuring that the air blower 10 rotates to the preset position and improving the accuracy of the air outlet angle of the air blower 10.

It should be noted that the above embodiment is only an optimal embodiment of the specific structures of the first limiting portion 12 and the second limiting portion 32; in some other embodiments, the first limiting portion 12 and the second limiting portion 32 may adopt other fit modes. For example: the matching structures of the first limiting portion 12 and the second limiting portion 32 in the above embodiment are interchanged, that is, the first limiting portion 12 is the limiting groove, and the second limiting portion 32 is the limiting protrusion. For another example: the first limiting portion 12 is still the limiting protrusion, the second limiting portion 32 may be two limiting protrusions, and the first limiting portion 12 is located between the two limiting protrusions of the second limiting portion 32. When the air blowers 10 rotate, the first limiting portion 12 moves between the two limiting protrusions to form the rotation stroke range of the air blowers 10. When the first limiting portion 12 is in contact with one of the limiting protrusions, limiting fit is formed, the air blowers 10 continuously rotate, and vice versa.

As shown in FIG. 6, the mounting bracket 30 includes a sheet metal bracket, an upper bracket 35 and a lower bracket 36, the upper bracket 35 is detachably connected to the lower bracket 36, the upper bracket 35 and the lower bracket 36 are mounted on the sheet metal bracket, the upper bracket 35 has a first assembling groove, the lower bracket 36 has a second assembling groove, and the first assembling groove and the second assembling groove enclose the assembling hole 31. To prevent the rotating structure 11 of the air blowers 10 from disengaging from the assembling hole 31, a guide rail is arranged on a surface of the rotating structure 11, and a guide groove is formed in the second assembling groove. Through the cooperation between the guide groove and the guide rail, the rotating structure 11 can be prevented from disengaging from the assembling hole 31, and the reliability and stability can be improved.

Figure 2:
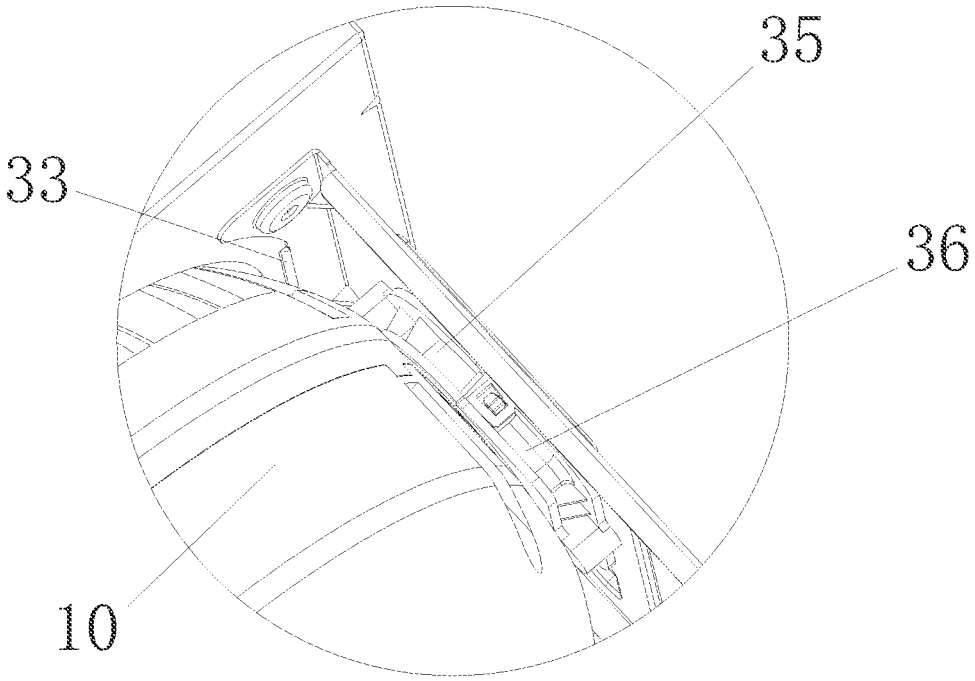
FIG. 2 is a partial enlarged view of an area enclosed by a circle A in FIG. 1.

As shown in FIG. 2, to facilitate the assembling of the mounting bracket 30, the mounting bracket 30 has an auxiliary limiting tongue 33 for mounting and limiting. The mounting bracket 30 is provided with a positioning groove at an assembling position on an air duct. During assembling, the auxiliary limiting tongue 33 can be inserted into the positioning groove to position the mounting bracket 30. Furthermore, the auxiliary limiting tongue 33 may mate with the positioning groove, so that the mounting bracket 30 is fixed. In this way, during assembling, an operator can insert the auxiliary limiting tongue 33 into the limiting groove for temporary fixation. The mounting bracket 30 will not fall off under the cooperation of the auxiliary limiting tongue 33 and the positioning groove. Therefore, the operator can then vacate double hands to fix the mounting bracket 30 through screws, thereby improving the assembling efficiency.

In addition, the whole air blower assembly may be located at an assembling port position of the ducted air conditioner, and the mounting bracket 30 may be fixed with the air duct through a bolt at a position close to the assembling hole 31, so that the operation to the mounting bracket 30 can be facilitated in the mounting and disassembling process.

In some embodiments, the mounting bracket 30 has a handheld hole 34 for a finger to pass through, so that the air blower assembly can be carried conveniently in the assembling and disassembling process.

Figure 7:
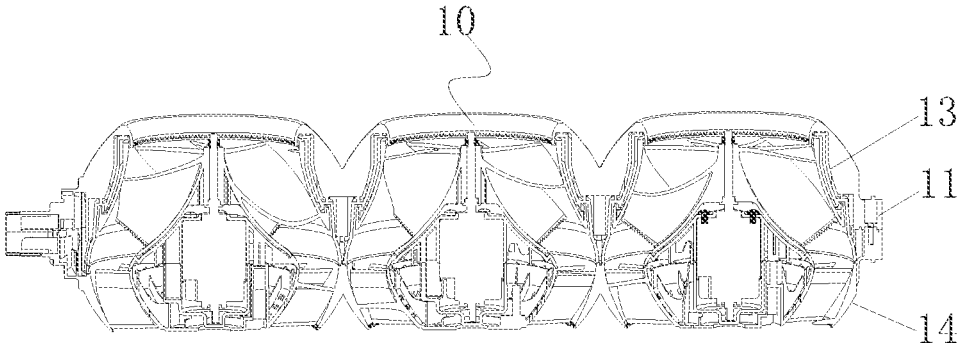
FIG. 7 is a structural schematic diagram of a volute casing in an embodiment of an air blower assembly of the present disclosure.

As shown in FIG. 7, a volute casing of the air blower 10 includes a first shell 13 and a second shell 14 which are connected to each other, and the first shells 13 of all the air blowers 10 are integrally formed, and/or the second shells 14 of the air blowers 10 are integrally formed.

Specifically, the volute casing of each of the air blowers 10 may be divided into an upper part and a lower part, that is, the first shell 13 and the second shell 14. The first shells 13 of all the air blowers 10 may be integrally formed, and the second shells 14 of all the air blowers 10 may be integrally formed. The first shells 13 and the second shells 14 are buckled to form a plurality of independent volute casing structures. In other embodiments, all the first shells 13 may be integrally formed and the second shells 14 may be independent, and vice versa.

In addition, to facilitate the maintenance of the air blowers 10, the air blowers 10 may be detachably connected.

In this embodiment, the air blower 10 is a mixed flow air blower. The mixed flow air blower is a mixed flow air blower between an axial mixed flow air blower and a centrifugal mixed flow air blower, an impeller of the mixed flow air blower makes the air do centrifugal motion and axial motion, and the airflow motion in the volute casing is mixed with two motion forms, that is, axial flow and centrifugal, so it is called "mixed flow". The volume of the mixed flow air blower can be reduced, and the flow direction and the air pressure of the airflow can be ensured, so the mixed flow air blower is mounted in the ducted air conditioner, the wind direction can be reversible, and the air outlet direction can be changed. In other embodiments, the air blower 10 may be an axial flow air blower or a centrifugal air blower.

It should be noted that the driving mode of the driving apparatus 20 in this embodiment is electrical driving, for example, driving is performed by a motor. In other embodiments that are not disclosed, the driving apparatus 20 may be a manual driving mode, for example, by manually rotating the rotary knob. It is also possible to drive the air blower 10 through the rotary knob to rotate.

Figure 8:
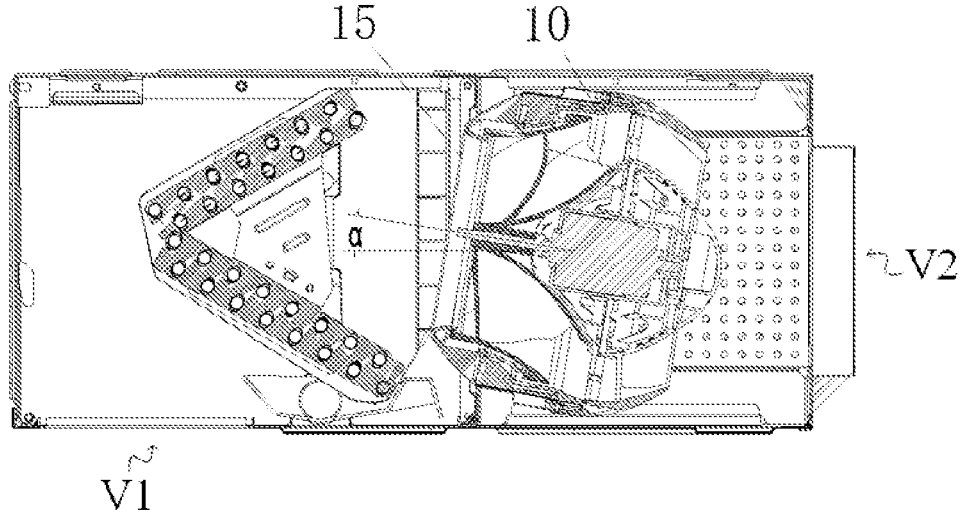
FIG. 8 is a sectional view of some embodiments of a ducted air conditioner of the present disclosure in a cooling mode.
Figure 9:
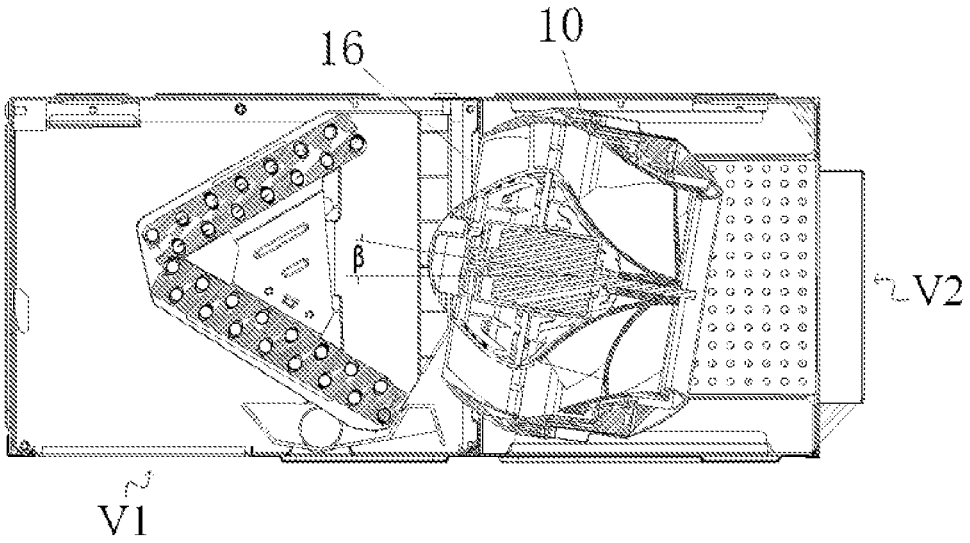
FIG. 9 is a sectional view of some embodiments of a ducted air conditioner of the present disclosure in a heating mode.

FIG. 8 is a sectional view of some embodiments of a ducted air conditioner of the present disclosure in a cooling mode. FIG. 9 is a sectional view of some embodiments of a ducted air conditioner of the present disclosure in a heating mode. Referring to FIG. 8 and FIG. 9, the embodiments of the present disclosure provide a ducted air conditioner, including the above-mentioned air blower assembly.

A shell of the ducted air conditioner is provided with a lower air port V1 and a side air port V2, and the air blower 10 has a first orientation and a second orientation. When the ducted air conditioner is in a cooling mode, the air blower 10 is located in the first orientation, the lower air port V1 is configured to take in air and the side air port V2 is configured to exhaust air. When the ducted air conditioner is in a heating mode, the air blower 10 is located in the second orientation, the side air port V2 is configured to take in air and the lower air port V1 is configured to exhaust air.

As shown in FIG. 8, when the lower air port V1 serves as an air inlet, the orientation of an air suction port 15 of the air blower 10 forms a first inclination angle $\alpha$ with a horizontal direction, and the angle range of the first inclination angle $\alpha$ meets: $0° \leq \alpha \leq 12°$. Optionally, the angle range of the first inclination angle $\alpha$ meets: $0° < \alpha \leq 12°$.

The ducted air conditioner of this embodiment is subjected to simulation test, and the value of the first inclination angle a is changed, wherein upward inclination relative to the horizontal direction is a positive angle, and downward inclination relative to the horizontal direction is a negative angle. The simulation result is as follows:

| Angle | Rotating Speed (rpm) | Air Volume ($m^3/h$) | Noise (dB) |
|---|---|---|---|
| −3.0 | 2200 | 478 | 46.2 |
| 0.0 | 2200 | 518 | 43.5 |
| 7.5 | 2200 | 533 | 42.2 |
| 12.0 | 2200 | 525 | 43.7 |
| 14.0 | 2200 | 493 | 45.8 |

According to the simulation data, in a case that $\alpha$ is 7.5°, the air volume reaches a maximum value, and the noise reaches a minimum value; in a case that $\alpha$ increases to 12°, the air volume begins to decrease and the noise begins to increase; in a case that $\alpha$ continuously increases to 14°, the attenuation of the air volume continuously increases and the noise increases obviously; in a case that a decreases to 0°, the air volume begins to decrease and the noise begins to increase; and in a case that $\alpha$ continuously decreases to −3°, the attenuation of the air volume continuously increases and the noise increases obviously. That is, in a case that the first inclination angle $\alpha$ is in the range of $0° \leq \alpha \leq 12°$, the deviations of the air volume and the noise are small and the effect is the best, and the change is great after a critical value is exceeded, so that the normal work of the ducted air conditioner cannot be ensured.

In addition, in a case that the lower air port V1 serves as the air inlet, after then the air blower 10 inclines, the air suction port 15 can suck the air from a part away from a water-receiving disk, thereby avoiding the influence on the air inlet of the air blower 10 due to blocking airflow by the water-receiving disk, ensuring the air volume of the air blower 2, and finally ensuring the heat exchange efficiency of the ducted air conditioner.

As shown in FIG. 9, in a case that the lower air port V1 serves as the air outlet, the orientation of an air exhaust port 16 of the air blower 10 forms a second inclination angle $\beta$ with the horizontal direction, and the angle range of the second inclination angle $\beta$ meets: $0° \leq \beta \leq 15°$. Optionally, the angle range of the second inclination $\beta$ meets: $0° < \beta \leq 15°$.

The mixed flow air blower of this embodiment is subjected to simulation test, and the value of the second inclination angle $\beta$ is changed, where upward inclination relative to the horizontal direction is a positive angle, and downward inclination relative to the horizontal direction is a negative angle. The simulation result is as follows:

| Angle | Rotating Speed (rpm) | Air Volume ($m^3/h$) | Noise (dB) |
|---|---|---|---|
| −2.0 | 2200 | 469 | 48.8 |
| 0.0 | 2200 | 504 | 42.8 |
| 7.2 | 2200 | 526 | 41.3 |
| 15.0 | 2200 | 510 | 42.6 |
| 16.0 | 2200 | 476 | 44.2 |

According to the simulation data, in a case that $\beta$ is 7.2°, the air volume reaches a maximum value, and the noise reaches a minimum value; in a case that $\beta$ increases to 15°, the air volume begins to decrease and the noise begins to increase; in a case that $\beta$ continuously increases to 16°, the attenuation of the air volume continuously increases and the noise increases obviously; in a case that $\beta$ decreases to 0°, the air volume begins to decrease and the noise begins to increase; and in a case that $\beta$ continuously decreases to −2°, the attenuation of the air volume continuously increases and the noise increases obviously. That is, in a case that the second inclination angle $\beta$ is in the range of $0° \leq \beta \leq 15°$, the deviations of the air volume and the noise are small and the effect is the best, and the change is great after a critical value is exceeded, so that the normal work of the ducted air conditioner cannot be ensured.

In a case that the lower air port V1 serves as the air outlet, after the air blower 10 inclines, most of the airflow blown out by the air exhaust port 16 flows above the water-receiving disk and is not blocked by the water-receiving disk, thereby ensuring the air volume of the air blower 10 and finally ensuring the heat exchange effect of the ducted air conditioner.

Apparently, the above implementation manners of the present disclosure are only examples for clearly describing the present disclosure and do not limit the implementation manners of the present disclosure. Those skilled in the art may make modifications in other forms based on the above description. All of the implementation manners cannot be exhausted here. All obvious changes or modifications that belong to the technical solutions of the present disclosure shall still fall within the protection scope of the present disclosure.

What is claimed is:

1. An air blower assembly, comprising:

a plurality of air blowers, wherein the plurality of air blowers are arranged and structurally connected in a linear row and capable of rotating at a same time to change orientations of air outlets of the plurality of air blowers, and the plurality of air blowers are configured to rotate about a common axis;

a mounting bracket, wherein the plurality of air blowers are connected to the mounting bracket; and a driving apparatus, in driving connection with the plurality of air blowers and configured to drive the plurality of air blowers to rotate;

wherein rotation of each air blower of the plurality of air blowers refers to overall rotation of the each air blower, and the mounting bracked has an auxiliary limiting tongue for mounting and limiting.

2. The air blower assembly according to claim 1, wherein at least one of the plurality of air blowers is connected to the driving apparatus, and at least one of the plurality of air blowers is connected to the mounting bracket.

3. The air blower assembly according to claim 2, wherein the mounting bracket comprises two first mounting brackets, which are rotatably connected to an air blower located at a first end of the plurality of air blowers and an air blower located at a second end of the plurality of air blowers, respectively; and the driving apparatus is in driving connection with the air blower located at the first end of the plurality of air blowers.

4. The air blower assembly according to claim 2, wherein the mounting bracket comprises a second mounting bracket located between adjacent two air blowers.

5. The air blower assembly according to claim 2, wherein the mounting bracket has an assembling hole; and the air blower connected to the mounting bracket has a rotating structure, and the rotating structure is rotatably arranged in the assembling hole.

6. The air blower assembly according to claim 5, wherein the rotating structure has a first stop, the mounting bracket has a second stop, the second stop is located on a moving path of the first stop, and the first stop is configured that when the rotating structure rotates to a preset position, the first stop mates with the second stop so as to limit a continuous rotation of the rotating structure.

7. The air blower assembly according to claim 1, wherein the mounting bracket has a handheld hole for a finger to pass through.

8. The air blower assembly according to claim 5, wherein the mounting bracket comprises: an upper bracket and a lower bracket, the upper bracket is detachably connected to the lower bracket, the upper bracket has a first assembling groove, the lower bracket has a second assembling groove, and the first assembling groove and the second assembling groove enclose the assembling hole.

9. The air blower assembly according to claim 1, wherein a volute casing of an air blower comprises a first shell and a second shell which are connected to each other, and first shells of the plurality of air blowers are integrally formed.

10. The air blower assembly according to claim 1, wherein a volute casing of an air blower comprises a first shell and a second shell which are connected to each other, and second shells of the plurality of air blowers are integrally formed.

11. The air blower assembly according to claim 1, wherein the air blowers are detachably connected.

12. The air blower assembly according to claim 1, wherein each of the air blowers is any one of a mixed flow air blower, an axial flow air blower or a centrifugal air blower.

13. The air blower assembly according to claim 1, wherein the driving apparatus is driven by a motor or driven manually.

14. A ducted air conditioner, comprising the air blower assembly according to claim 1.

15. The ducted air conditioner according to claim 14, wherein a shell of the ducted air conditioner is provided with a lower air port (V1) and a side air port (V2), and each of the air blowers has a first orientation and a second orientation;

when the ducted air conditioner is in a cooling mode, the air blower is located in the first orientation, the lower air port (V1) is configured to take in air, and the side air port (V2) is configured to exhaust air; and when the ducted air conditioner is in a heating mode, the air blower is located in the second orientation, and the side air port (V2) is configured to take in air, and the lower air port (V1) is configured to exhaust air.

16. The ducted air conditioner according to claim 15, wherein an orientation of an air suction port of the air blower is configured that when the lower air port (V1) serves as an air inlet, the orientation of the air suction port form a first inclination angle $\alpha$ with a horizontal direction, and an angle range of the first inclination angle $\alpha$ meets: $0° \leq \alpha \leq 12°$.

17. The ducted air conditioner according to claim 15, wherein an orientation of an air exhaust port of the air blower is configured that when the lower air port (V1) serves as an air outlet, the orientation of the air exhaust port form a second inclination angle $\beta$ with a horizontal direction, and an angle range of the second inclination angle $\beta$ meets: $0° \leq \beta \leq 15°$.

* * * * *